United States Patent [19]

Krumm

[11] Patent Number: 4,901,766

[45] Date of Patent: Feb. 20, 1990

[54] METHOD AND APPARATUS FOR COOLING WARP THREADS IN A LOOM

[75] Inventor: Valentin Krumm, Hergensweiler, Fed. Rep. of Germany

[73] Assignee: Lindauer Dornier Gesellschaft mbH, Lindau/Bodensee, Fed. Rep. of Germany

[21] Appl. No.: 276,216

[22] Filed: Nov. 23, 1988

[30] Foreign Application Priority Data

Mar. 8, 1988 [DE] Fed. Rep. of Germany ..... 3807556

[51] Int. Cl.[4] ..... D03J 1/02

[52] U.S. Cl. ..... 139/36; 139/291 R

[58] Field of Search ..... 139/1 R, 1 C, 36, 291 R

[56] References Cited

U.S. PATENT DOCUMENTS

| | | | |
|---|---|---|---|
| 3,491,801 | 1/1970 | Lippuner | 139/1 C |
| 4,194,540 | 3/1980 | Reynolds | 139/291 R |
| 4,678,012 | 7/1987 | Graham et al. | 139/1 C |

FOREIGN PATENT DOCUMENTS

| | | | |
|---|---|---|---|
| 151341 | 8/1985 | Japan | 139/36 |
| 252346 | 11/1986 | Japan | 139/36 |
| 8003441 | 2/1981 | Netherlands | 139/36 |

*Primary Examiner*—Henry S. Jaudon

*Attorney, Agent, or Firm*—W. G. Fasse; D. H. Kane, Jr.

[57] ABSTRACT

The warp threads in a loom are cooled, in order to prevent damage to the warp threads due to heat generation by the contact between the warp threads and loom components. Such contact can generate temperatures of 50° to 80° C. due to thread friction and thread shifting, whereby capillary breaks of the warp threads are caused so that continued weaving becomes impossible. Such heat generation is avoided by cooling the loom components which contact the warp threads. A cooling fluid is circulated through the warp thread contacting components. The cooling fluid may be a liquid or a gas. At least the leasing or fulling mill is cooled in this manner. The cooling is preferably carried out to such an extent that condensation water forms on the surfaces of the cooled components, whereby the condensation water acts as a lubricant for the warp threads.

10 Claims, 1 Drawing Sheet

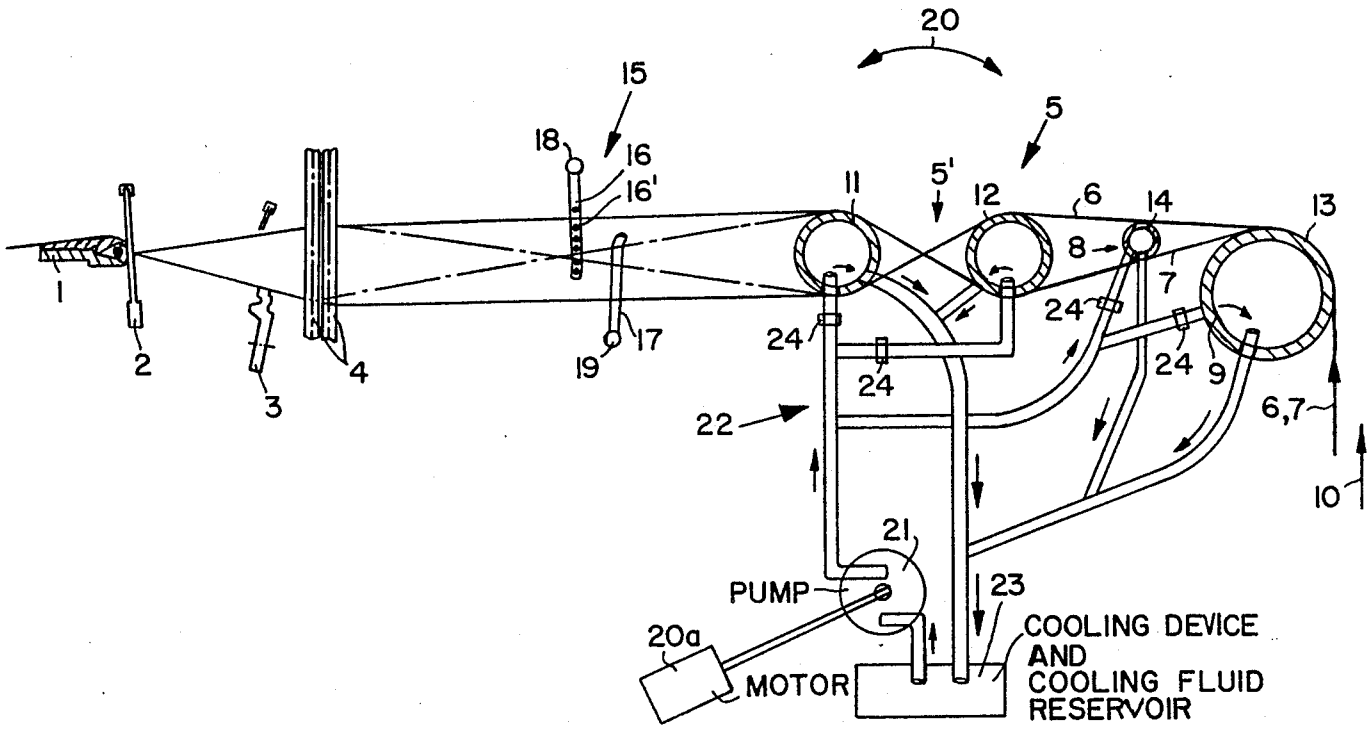
COOLING DEVICE AND COOLING FLUID RESERVOIR
PUMP
MOTOR

METHOD AND APPARATUS FOR COOLING WARP THREADS IN A LOOM

FIELD OF THE INVENTION

The invention relates to a method and apparatus for cooling warp threads in a loom or weaving machine for especially heavy woven fabrics such as yacht sailcloths. Such looms are equipped with a counter roller, a stationary or movable backrest, a leasing fulling mill, and a thread spreader.

DESCRIPTION OF THE PRIOR ART

According to the current state of the art, high grade sailcloths and other heavy woven fabrics are produced on looms having a counter roller, a rigid backrest, a leasing (fulling) mill or roller set for forming a thread crossing, and a threaded rod spreader. In such prior art looms, the warp thread material is subject to relatively high loads caused by the counter roller and the rigid backrest. For this reason, only warp threads or yarns having a minimum of three hundred twists per meter may be used for weaving on these conventional looms.

However, twisted warp thread material generally reduces the fabric quality for example of sailcloth, especially when 100% polyester is used for the warp thread material. In order to increase the fabric quality, it is advantageous to use untwisted warp threads. Furthermore, the twisting of the warp threads increases the total production costs of the fabric because an additional work step is required for twisting the warp threads to a highly twisted state. For these reasons it is more and more advantageous to produce high quality heavy weight fabrics with untwisted warp threads, which results in a better fabric quality at lower costs.

A typical quality which is desired or called for on the market, but which is not weavable according to the state of the art, is exemplified by the following material parameters:

weft material: d tex 1100, 100% polyester, zero twist
weft count/cm: 15.75
warp material: d tex 288, 100% polyester zero twist
warp threads/cm: 43
weaving spread factor: 155.39%.
(According to Professor Walz).

The major problem which makes such a fabric impossible to produce on conventional looms is seen in that capillary breaks arise in the warp threads due to the zero twist, whereby production of a woven material becomes impossible in terms of achieving a desired quality and even in terms of maintaining a continuous production.

It has been attempted to counteract the above mentioned problems through mechanical adjustments of conventional looms. Namely, for weaving such heavy woven fabrics, the counter roller has been omitted, the backrest has been supported in a rotatable and elastically yielding manner, and the leasing fulling mill causing the thread cross-over has been installed to be freely swinging without an eccentric drive.

By using the above described measures it has been possible heretofore to carry out a partially successful weaving of heavy woven fabrics for weaving times of up to 2 to 5 hours, depending on the weft count. The production time is limited because the leasing fulling mill becomes heated to a temperature of 50° to 80° C. due to the thread shifting for one-to-one weave. At these temperatures capillary breaking of the warp material becomes so frequent that it is impossible to continue weaving. It has been found that if the weaving is carried out without a leasing fulling mill, and with a reduced weft density, then the backrest roller becomes heated instead, and the same problems of capillary breaks in the warp threads arise.

For crystalline PETP (polyester), the crystallite melting temperature starts at 50° C., whereupon the polyester warp thread material becomes rubbery or visco-elastic. Warp threads of polyamide PA 6.6 (nylon 66) or polyamide PA 6 (nylon 6) behave in a similar manner. As soon as the warp thread material becomes visco-elastic or rubbery (entropy elastic), the tensile strength of the yarn or thread is correspondingly reduced, and capillary breaking cannot be avoided.

OBJECTS OF THE INVENTION

In view of the foregoing it is the aim of the invention to achieve the following objects singly or in combination:

- to construct a weaving machine or loom which is capable of weaving heavy woven fabrics and yacht sailcloth of high quality, substantially continuously;
- to use untwisted warp threads for effectively weaving in such a weaving machine;
- to prevent components of such a weaving machine which contact the warp threads from being heated by friction or thread shifting;
- to prevent capillary breaking of warp threads in such a weaving machine;
- to cool, especially the leasing fulling mill and in general, all the loom components which contact the warp threads in such a weaving machine by circulating a cooling fluid through the components; and
- to encourage the formation of water condensation on the surface of the loom components contacted by the warp threads, by the cooling of these loom components, whereby the condensation water acts as a lubricant and a passive treatment medium for the warp threads passing over the cooled components.

SUMMARY OF THE INVENTION

The above objects have been achieved in a loom, especially a weaving machine for heavy woven fabrics and yacht sailcloth according to the invention by cooling the warp threads. This can be accomplished in that components of the weaving machine which contact the warp threads are cooled. According to the invention, it is realized that if the pertinent components of the weaving machine are cooled by means of a cooling fluid in the form of a liquid or gas, then the above described problems of overheating, softening, and capillary breaking of the warp threads no longer occur.

According to a preferred embodiment of the invention the components of the weaving machine which contact the warp threads are cooled, in such a manner, or to such an extent, that condensation water forms on the cooled machine components. That is to say, atmospheric moisture condenses to form water droplets on the cooled machine components. The condensation water acts as a lubricant for the PETP warp threads and has a protective effect on the highly loaded warp threads during the weaving process. The condensation water reduces on the one hand the friction, and on the other hand it prevents the synthetic woven fabric from being transformed into the visco-elastic or rubbery characteristic range. Furthermore, for polyamide or nylon yarns or threads, the condensation water lubrication achieves a considerable advantage in that the presence of the condensation water leads to a strengthening and densifying of the warp thread material due to the water absorption capacity of the material. Especially the strain at failure and the impact strength of the polyamide threads are increased.

According to a further embodiment of the invention additional cooling lamellae or fins are provided in the loom shed for cooling the upper and/or lower course of warp threads, whereby the cooling fins or lamellae provide a guide function as well as a cooling function, and the formation of condensation on the thin surfaces acts as a lubrication for the warp threads as described above. Furthermore, holes or spray nozzles may be provided in the lamellae or fins for spraying the cooling fluid directly onto the warp threads for an increased cooling or lubricating effect. Cooled air may be blown directly onto the warp threads and/or the warp thread contacting loom components.

BRIEF DESCRIPTION OF THE DRAWING

In order that the invention may be clearly understood, it will now be described, by way of example, with reference to the accompanying single FIGURE of the drawing which shows a schematic side view of the relevant components of a weaving machine improved according to the invention.

DETAILED DESCRIPTION OF PREFERRED EXAMPLE EMBODIMENTS AND OF THE BEST MODE OF THE INVENTION

The warp threads 6, 7 move from right to left in the Figure. Arrow 10 indicates the entrance movement direction of the warp threads upstream of a backrest beam or roller 9.

As shown in the single figure, a spreader rod 1 is arranged downstream of a weaving reed 2 as viewed in the warp thread moving direction. A backrest rail 3 is arranged upstream or ahead of the weaving reed 2.

In an arrangement which is essentially known for weaving machines, a heald frame 4 is arranged upstream of the backrest rail 3 and, as is generally used especially for heavy woven fabrics, a leasing (fulling) mill 5 for forming a thread crossing 5' is arranged upstream of the heald frame 4. In this example embodiment, the leasing fulling mill 5 includes two parallel shafts or drums 11 and 12 arranged at a spacing from one another on a holding frame not shown, but which is tiltably supported and may be actively driven to rock back and forth in a swinging direction shown by an arrow 20. Alternatively, the leasing fulling mill 5 may be supported to swing freely as a pendulum instead of being actively driven.

A separating or splitting rod 8 is arranged upstream of the leasing fulling mill 5 for separating the two courses of warp threads 6 and 7 and to provide an additional shed separation for preventing a binding of the two warp thread courses 6 and 7. The warp threads 6 and 7 arrive from the right side of the Figure in the direction of the arrow 10 from a warp beam which is not shown, and are then guided over the backrest beam or backrest roller 9 before being separated by the separating rod 8 and a first roller 12 of the leasing fulling mill 5 to form the shed.

According to the invention, at least the leasing fulling mill 5 comprises two hollow pipes 11 and 12, whereby a cooling medium flows through each pipe 11, 12. The cooling medium is preferably water because water has a good thermal conductivity and thermal capacity. Alternatively, the cooling medium may be a liquid other than water or may even be a gas such as, for instance, carbon dioxide or other gases.

A motor **20*a* drives a pump 21 for circulating the cooling medium through a conduit system 22, preferably of flexible hoses, from a conventional cooling device and reservoir 23 and back again as indicated by the arrows. Valves 24** are located in the individual conduits in such positions that the cooling medium supply for each loom component to be cooled can be controlled individually and/or in groups.

In a further embodiment of the invention, other components of the weaving machine which contact the warp threads 6, 7 are also cooled. For example, the backrest roller 9 may be embodied as a hollow pipe 13, and the separating rod 8 may be embodied as a hollow pipe 14 for carrying a circulated cooling medium as shown, when the respective valves are opened, e.g. manually or automatically in response to a temperature measurement.

Instead of a single separating rod 8, several separating rods may be provided between the warp threads 6 and 7, in the area upstream of the leasing fulling mill 5.

In order to provide additional cooling for the warp threads 6 and 7, at least one cooling comb 15 having cooling fins or lamellae 16, 17 is arranged in the loom shed. In the example embodiment shown, the cooling comb 15 comprises a row of lamellae or cooling fins 16, 17 reaching into the upper or lower warp course of the shed in the manner of a comb, whereby only one lamellae 16, 17 is visible in each thread course as shown in the drawing. Instead of providing such a cooling comb arrangement in the upper and lower shed courses, it is also possible to arrange a cooling comb 15 only in the upper or only in the lower warp shed. It is also possible to arrange several cooling combs 15 at a spacing one behind the other from the interlacing point to the warp beam. Cooling medium flows through a respective pipe 18, 19 which is thermally conductively connected to each lamellae or fin 16, 17 of the comb in order to conduct away heat. The pipes 18, 19 may also be connected to the shown cooling medium circulating system or may be connected to a separate cooling system that could circulate a different cooling medium, e.g., a gas instead of a liquid.

Instead of using rows of lamellae or fins which are arranged on the respective cooled pipe 18, 19, it is also possible according to a further embodiment of the invention, that the lamellae 16 or 17 themselves are embodied as hollow pipes which carry a flow of cooling medium. This embodiment is especially advantageous, because the formation of condensation on the component surfaces to provide a lubricating effect for the warp threads as described below, occurs directly on the lamellae surfaces contacted by the threads. In this embodiment outlet holes or spray nozzles 16' may be provided in the separate fins or lamellae 16 to allow the cooling medium to spray or blow directly into the loom shed to directly cool the warp threads. This is advantageous because the direct cooling is the most efficient and fastest method of cooling the warp threads and additionally, the cooling medium may act as a lubricant for the warp threads.

In any case, the cooled surfaces of the components of the weaving machine which contact the warp threads, namely at least the leasing fulling mill 5, but preferably also the separating rod 8, the backrest roller 9, as well as the cooling fins 16 and 17 are preferably cooled to such an extent below the dew point that atmospheric moisture condenses on the cooled surfaces as condensation water. The condensation water acts as a lubricant and as a passive treatment medium for the warp threads. If a gaseous cooling medium is sprayed from the cooling lamellae 16, 17 through nozzles 16' directly onto the warp threads, the warp threads may be cooled to the extent that condensation forms directly on the threads.

In order to further reduce the undesirable heating of the weaving machine components which contact the warp threads, the surfaces of these components are preferably coated with a friction reducing surface coating, for example, a coating of chrome or a synthetic material. In this embodiment it is especially advantageous that the condensation water which forms on the cooled surfaces reduces the wear on those surfaces. This is especially important for the use of synthetic material surfaces.

It is further provided according to the invention that if the weaving machine is to be operated without a fulling leasing mill 5, then at least the backrest roller 9 and preferably all the other machine components which contact the warp threads are cooled as disclosed.

Although the invention has been described with reference to specific example embodiments, it will be appreciated, that it is intended to cover all modifications and equivalents within the scope of the appended claims.

What I claim is:

1. An apparatus for cooling warp threads in a weaving machine, especially for heavy, woven fabrics such as yacht sailcloths, comprising at least one hollow loom component for contacting a warp thread in said weaving machine, and means for circulating a cooling fluid through said warp thread contacting hollow loom component, said cooling fluid cooling said hollow loom component to such an extent that atmospheric moisture condenses on said hollow loom component as condensation water which cools and lubricates said warp thread.

2. The apparatus of claim 1, wherein said warp thread contacting hollow components comprises a leasing means having two pipes arranged to form a thread crossing between said two pipes, said cooling fluid circulating means cooling both pipes of said leasing means.

3. The apparatus of claim 1, wherein said warp thread contacting components comprise tubular members (8, 9), such as a backrest roller and a separation roller connected to said cooling fluid circulating means.

4. The apparatus of claim 1, further comprising cooling fins forming combs (16, 17) intermeshing in thermal conducting contact with said warp threads, and conduit means (18, 19) connecting said cooling fluid circulating means to said cooling fins for cooling said cooling fins.

5. The apparatus of claim 1, further comprising pipe means and spray nozzle means for spraying or blowing a cooling medium onto said warp threads.

6. A method for preventing capillary breaking of warp threads in a weaving machine comprising the following steps:

(a) providing hollow passages in components of said weaving machine which contact said warp threads;

(b) flowing a cooling fluid through said hollow passages and (c) maintaining said cooling fluid at a temperature below a dew point temperature so that atmospheric moisture forms condensation water on said components for cooling and lubricating said warp threads.

7. The method of claim 6, further comprising spraying a cooling medium onto said warp threads.

8. The method of claim 6, comprising using cooled water as said cooling fluid.

9. The method of claim 6, further comprising blowing a cooling medium additionally onto said warp threads.

10. The method of claim 9, further comprising using colled air as said cooling medium.

* * * * *

UNITED STATES PATENT AND TRADEMARK OFFICE

CERTIFICATE OF CORRECTION

PATENT NO. : 4,901,766

DATED : February 20, 1990

INVENTOR(S) : Valentin Krumm

It is certified that error appears in the above-identified patent and that said Letters Patent is hereby corrected as shown below:

Claim 2, line 2, Column 6, line 5, replace "components" by --component--;

Claim 3, line 2, Column 6, line 10, replace "components comprise" by --hollow component comprises--;

Claim 10, line 2, Column 6, line 40, replace "colled" by --cooled--.

Signed and Sealed this

Fifteenth Day of January, 1991

*Attest:*

HARRY F. MANBECK, JR.

*Attesting Officer*

*Commissioner of Patents and Trademarks*